US005669442A

United States Patent [19]

Gibson

[11] Patent Number: 5,669,442

[45] Date of Patent: Sep. 23, 1997

[54] NON-ROTATING PITLESS ADAPTER

[75] Inventor: Richard D. Gibson, Verona, Wis.

[73] Assignee: Baker Manufacturing Company, Evansville, Wis.

[21] Appl. No.: 563,322

[22] Filed: Nov. 28, 1995

[51] Int. Cl.[6] ..... E21B 43/00

[52] U.S. Cl. ..... 166/85.2

[58] Field of Search ..... 166/299, 55.7, 166/85.2; 175/312

[56] References Cited

U.S. PATENT DOCUMENTS 1,889,787 12/1932 Minor .
3,154,148 10/1964 Peterson ..... 166/85.2
3,158,201 11/1964 Springer .
4,298,065 11/1981 Baski .
4,751,968 6/1988 Ames et al. .
4,940,087 7/1990 Lien et al. .

*Primary Examiner*—William P. Neuder
*Attorney, Agent, or Firm*—Quarles & Brady

[57] ABSTRACT

A well construction includes a spool with a skirt that seats against a collar in a vertical well casing, the collar and skirt cooperating to limit the downwardly longitudinal movement of the spool within the casing. Both the skirt and collar form keyed surfaces each defined by a specific pattern of indentations and protrusions. The skirt and collar keyed surfaces are at least partially complementary so that, when the spool is in an operational position, the two surfaces intermesh and either eliminate or substantially reduce spool rotation within the well casing.

15 Claims, 5 Drawing Sheets

NON-ROTATING PITLESS ADAPTER

FIELD OF THE INVENTION

This invention relates generally to the removable portion of a well, or "spool", and particularly to a spool seating mechanism preventing spool rotation.

BACKGROUND OF THE INVENTION

One commonly designed well construction employs a tubular well casing that extends vertically downward from the surface of the earth. Lateral distribution from the well casing is provided by an underground line below a frost level within a particular geographical area. A pitless adapter, which includes a removable spool, provides a connecting device between the well casing and the surface, provides seals for the line from the well to the lateral distribution line, and provides the passages for the pump actuator or the pump motor electric lines. The pitless adapter allows the removal of a submerged pump or other device from the well without excavation. This is done by pulling the spool out of the discharge sleeve.

To install a spool within a well casing, the spool is descended through the tubular well casing until the spool seats against either a protrusion in the well casing or against an area on the wall of the well casing where the well casing narrows. The spool is threadably engaged with a pipe suspended therefrom, the distal lower end of which descends below a fluid table, usually a water table. When properly seated, the spool is aligned with the lateral distribution line and suspends the pipe extending downwardly below the fluid table.

A submersible fluid pump is secured to the lower end of the suspended pipe so that the pump is located below the fluid table. Power is supplied to the pump motor by electrical cables or other power lines, such as pneumatic hoses through the pump spool. In operation, when liquid is to be pumped to the surface, the pump is excited and forces water upward through the suspended pipe, through the spool and the lateral distribution pipe, and to a faucet or the like above the earth's surface.

The pump motor generates a torque to turn an internal pump impeller. Torque is always required to turn the pump impeller. Since there is rotational inertia of starting, torque can be much higher than running torque. The impeller blades force stagnant water into motion against the force of gravity and trapped pressure within the suspended pipe. This torque tries to rotate the pump about an axis defined by the suspended pipe (i.e. about a central well casing axis). Because the pump is securely connected to the suspended pipe which is in turn securely connected to the spool within the well casing, the pump torque imparts a rotating torque to the pipe and spool thereabove tending to rotate all of the components within the well casing about the central well casing axis.

Since power cables pass through the spool, rotation of the spool in the well could break power lines running to the pump motor. Unfortunately, component rotation can affect well system performance by changing system component orientation. In addition, component rotation can shorten the useful life of the spool generally and the sealing mechanisms associated with the spool specifically. Therefore, it is necessary to have some type of a mechanism which can limit system component rotation due to pump torque.

One solution secures the fluid pump below the fluid table to directly limit the affects of pump generated torque on component rotation. Because the fluid pump must be periodically removed for maintenance purposes, to facilitate pump removal, the pump generally is only secured to the lower end of the suspended pipe and not to other structures below the fluid table. To remove the pump, the suspended pipe can simply be lifted upwardly out of the well casing, the pump ascending therethrough.

Other solutions to component rotation have employed relatively complex mechanical locking mechanisms positioned at the top of the spool to secure the spool in a single orientation within the well casing. With the spool secured and the suspended pipe and pump securely connected thereto, the torque generated by the pump is absorbed by the mechanical locking mechanism and rotation is ideally minimized. With the mechanical locking mechanism located above the spool, the locking mechanism can be accessed from above to unsecure the spool for removal for maintenance purposes.

One type of mechanical locking mechanism includes a web member which attaches to the upper end of the spool and extends outwardly from the spool to the internal wall of the well casing. This mechanism can be used with conventional types of well casings. However, this mechanism is relatively difficult to install as, after proper orientation within the well casing, components must be manipulated to expand the mechanism outwardly toward the well casing. This mechanism often requires difficult screw manipulation deep within a well casing to install and thus is undesirable.

Another type of mechanical locking mechanism includes hold down hooks which extend radially outwardly from an upper end of the spool. The ends of the hooks are received in specially carved out portions of the well casing. In addition, because the hooks must be anchored in the internal walls of the well casing, the well casing must be specially modified to have extending portions into which hook receiving alcoves can be formed.

Thus, it would be advantageous to have a well system locking mechanism which is inexpensive to produce, easy to lock and unlock for installation and maintenance purposes, and eliminates spool rotation.

SUMMARY OF THE INVENTION

In accordance with the present invention, a well construction includes a spool with a skirt that seats against a collar in a vertical well casing, the collar and skirt cooperating to limit the downwardly longitudinal movement of the spool within the casing. Both the skirt and the collar form keyed surfaces, each defined by a specific pattern of indentations and protrusions. Preferably, the skirt and collar keyed surfaces are complementary so that, when the spool is in an operational position, the two surfaces intermesh or interleave.

One object of the present invention is to provide a locking mechanism to limit spool rotation within a well casing. When the skirt and collar are positioned so that their keyed patterns intermesh, the spool is held rotationally stationary relative to the well casing thus preventing spool rotation.

Another object is to limit spool rotation in a manner that facilitates easy and quick installation and removal. With a keyed skirt and collar, a spool can be rotationally secured simply by aligning keyed patterns on the collar and skirt so that the complementary patterns intermesh. This can be accomplished blindly by simply inserting a spool and associated suspended pipe down into a well casing until the skirt and collar make initial contact. The spool can then be manually rotated until the keyed patterns align, at which point the spool will descend into an intermeshed and operational position in which further rotation is prohibited without purposefully lifting the spool upwardly into a free position.

With the present invention, it is not necessary to manipulate screws or other mechanical components deep within the well casing to install the spool. In addition, it is not necessary to manipulate springs or other components within the well casing to remove the spool for maintenance. Removal can be accomplished by simply lifting the spool from the intermeshed and operational position.

Another object of the invention is to limit spool rotation in a relatively inexpensive manner. The present design can be implemented using components which typically already form part of conventional spool-well casing designs. By slightly modifying adjacent skirt and collar surfaces so as to define complementary keyed patterns, spool rotation can be eliminated without requiring additional locking mechanism components.

These and still other objects and advantages of the invention will become apparent from the description which follows. In the description, the preferred embodiments will be described with reference to the accompanying drawings. These embodiments do not represent the full scope of the invention. Rather, reference should be made to the claims herein for interpreting the full scope of the invention.

DESCRIPTION OF THE PREFERRED EMBODIMENT

Figure 1:
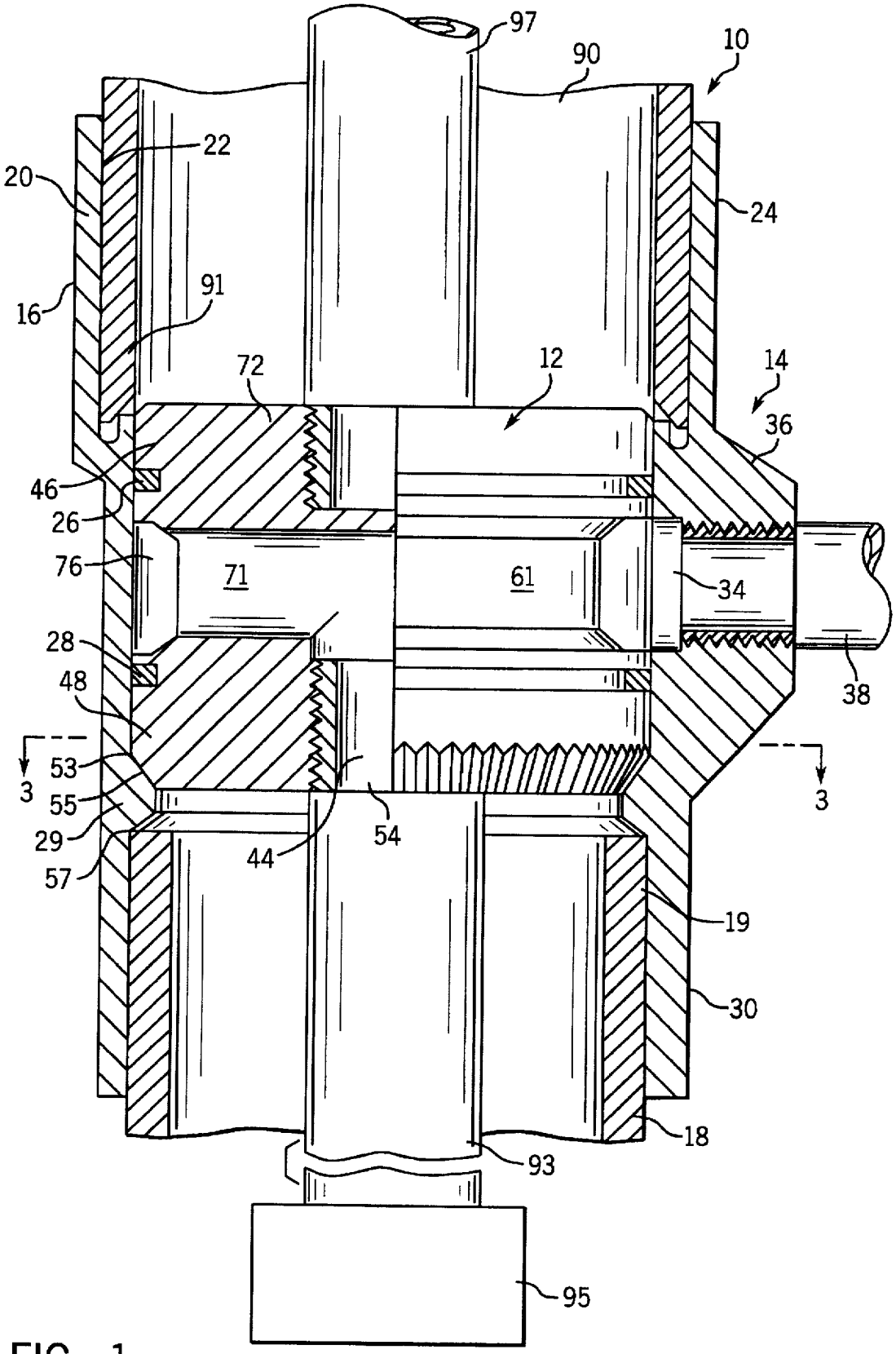
FIG. 1 is a fragmentary longitudinal vertical cross-section from the front showing a well casing and spool construction according to the present invention.

Referring to FIG. 1, a well constructed in accordance with the present invention is shown generally at 10. The well comprises upper well casing section 90, lower casing section 18 and well casing 14, all fluidly communicating. Additional well casing sections (not shown) may fluidly communicate with upper and lower well casing sections 90 and 18. Within well casing 14 lies pitless adapter or spool 12. The well casing 14 is a vertical tubing having an upper section 16 which extends downwardly away from the surface of the earth, and a lower section 30. The upper section 16 has a circumferential wall 20 with an inside surface 22 and an outside surface 24. The lower section 91 of well casing section 90 tightly fits into the upper section 16 of well casing 14.

Figure 4:
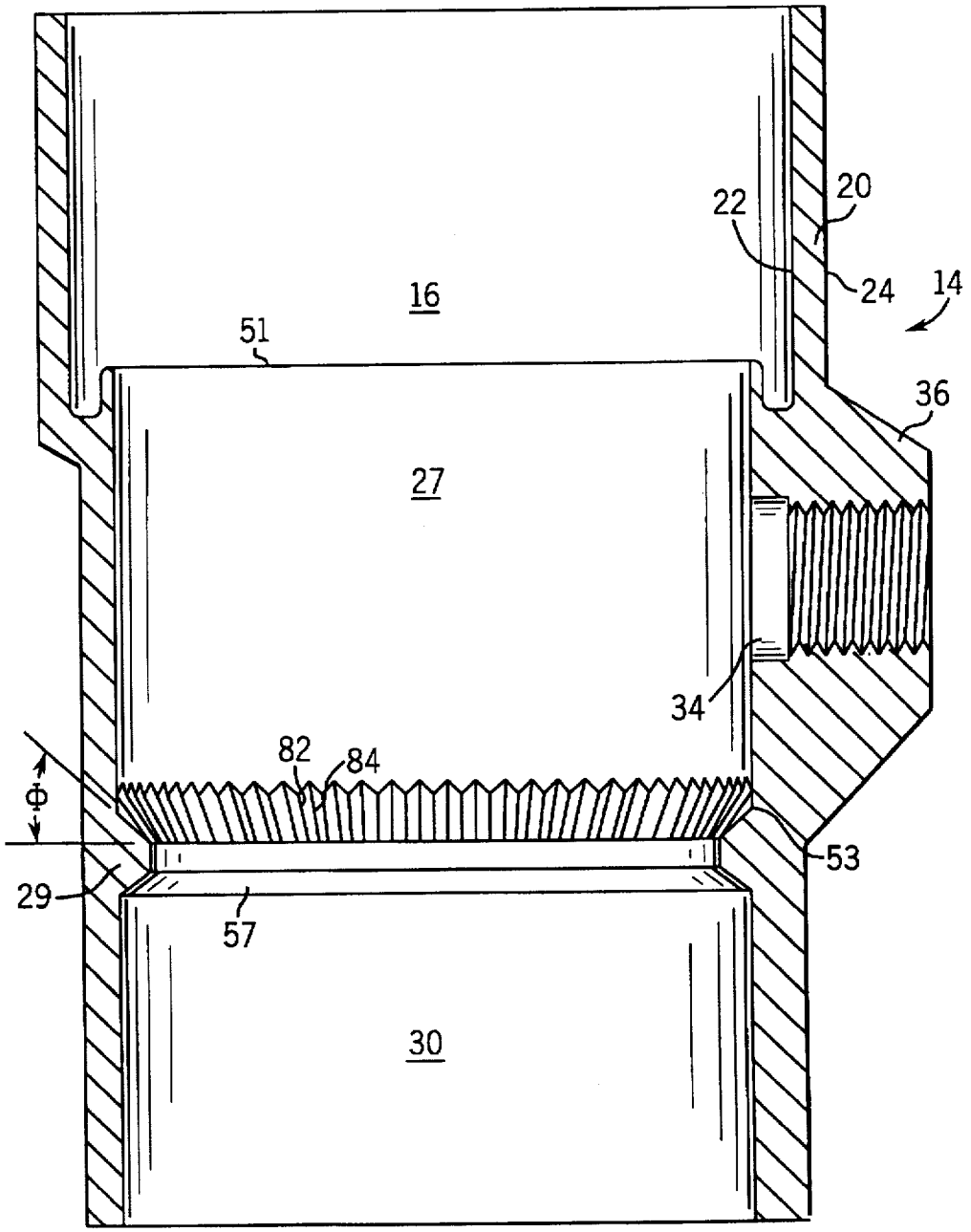
FIG. 4 is a cross-sectional view of a well casing of the present invention.

Referring also to FIG. 4, near the bottom of upper section 16, the inside surface 22 necks down to define a cylindrical inside surface 27 edged by upper and lower annular edges, 51, 53. The internal diameter of inside surface 27 is smaller than that of upper section 16. Upper elastomeric O-ring 26 tightly abuts cylindrical inside surface 27 below the upper annular edge 51. Lower elastomeric O-ring 28 tightly abuts cylindrical inside surface 27 above the lower edge 53. The lower edge 53 abuts collar 29, which is an annular flange extending around the inside surface 22 below inside surface 27. Collar 29 contains upper edge 55 and lower edge 57, and the internal diameter of collar 29 is substantially smaller than the internal diameter of inside surface 27. Lower section 30 of well casing 14 extends downwardly below collar 29 and accommodates the upper section 19 of lower well casing section 18. The lower edge 57 of the collar 29 tightly abuts the upper section 19 of wall casing section 18.

Between the two elastomeric O-rings 26, 28 the well casing 14 includes a laterally extending outlet sleeve 36. The sleeve 36 is internally threaded for receiving a laterally extending delivery pipe 38.

Referring to FIGS. 1, 2A, 2B, and 4, the spool 12 includes a wall 40 having an external surface 52. Coaxial with the central axis 88 of the spool 12 lies an internal spool chamber 44 which is open downwardly at inlet 54 and is capped and sealed by a web 56 at its upper end. Spool 12 contains upper sealing extension 46 and lower sealing extension 48. Each sealing extension 46, 48 extends radially outwardly from the spool's external surface 52 around the entire circumference of the spool 52. Upper sealing extension 46 and lower sealing extension 48 have similar external diameters, which are both slightly smaller than the diameter of inside surface 27. The diameters of the upper and lower sealing extensions 46, 48 are only slightly less than the diameters of associated upper and lower elastomeric O-rings 26, 28 respectively. Annular groove 64 is formed in the external surface 60 of upper sealing extension 46 and tightly accommodates upper elastomeric O-ring 26. Annular groove 66 is formed in the external surface 62 of lower sealing extension 48 and tightly accommodates lower elastomeric O-ring 28. Between upper sealing extension 46 and lower sealing extension 48 lies constricted waist segment 61 of spool 12, which has an external diameter substantially less than the external diameters of either upper sealing extension 46 or lower sealing extension 48.

Near the lower end of lower sealing extension 48 of spool 12, external surface 52 defines annular skirt 58 which forms an angled skirt surface. When the spool 12 is lowered into the well casing 14 as in FIG. 1, the annular skirt 58 seats against the upper edge 55 of collar 29 inside the well casing 14 and limits downward longitudinal movement of the spool 12. When spool 12 is in this position, the upper sealing extension 46 is adjacent to the upper elastomeric O-ring 26 and the lower sealing extension 48 is adjacent the lower elastomeric O-ring 28, and the O-rings 26, 28 are sandwiched between the external surfaces 60, 62 and inside surface 27, forming watertight seals.

Figure 2A:
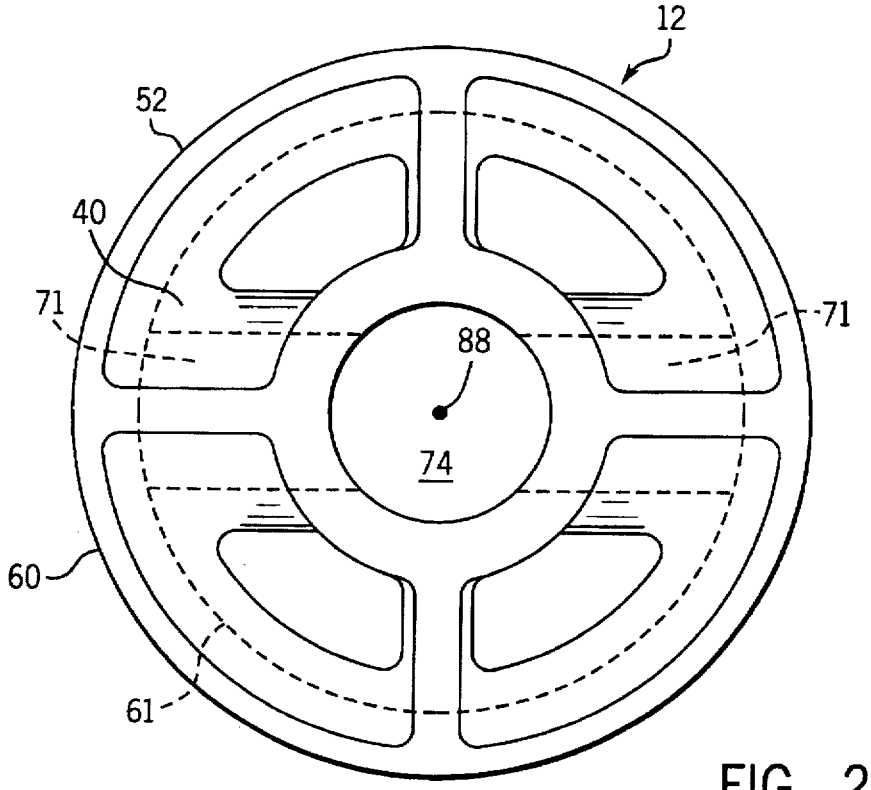
FIG. 2A is a top view of the spool of the present invention.
Figure 2B:
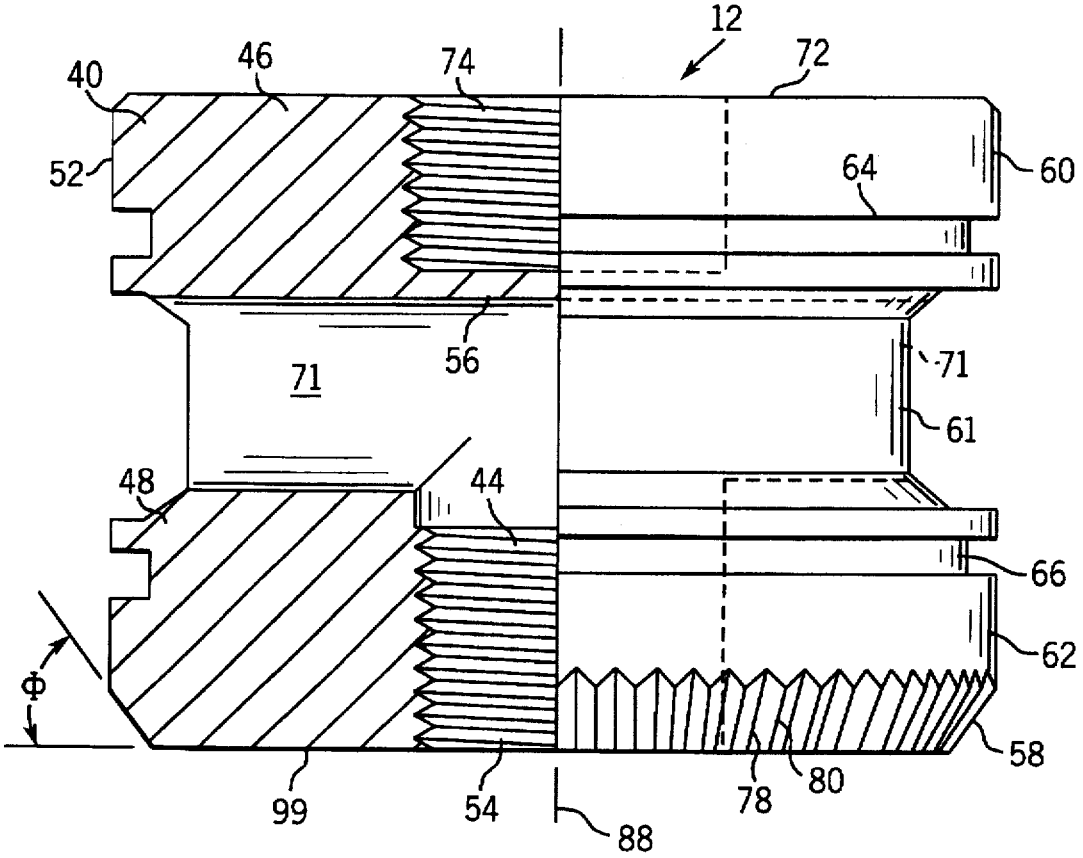
FIG. 2B is a partially fragmentary plan view of the spool of the present invention.

Referring still to FIG. 1, the inside surface 27, constricted waist 61, and upper and lower sealing extensions 46, 48 form an external spool chamber 76 with an outlet 34. Referring also to FIGS. 2A and 2B, the spool wall 40 also forms two lateral outlets 71 which allow fluid forced into internal chamber 44 to move into external chamber 76 where the fluid is redirected out outlet 34 into the lateral delivery pipe 38.

Figure 3:
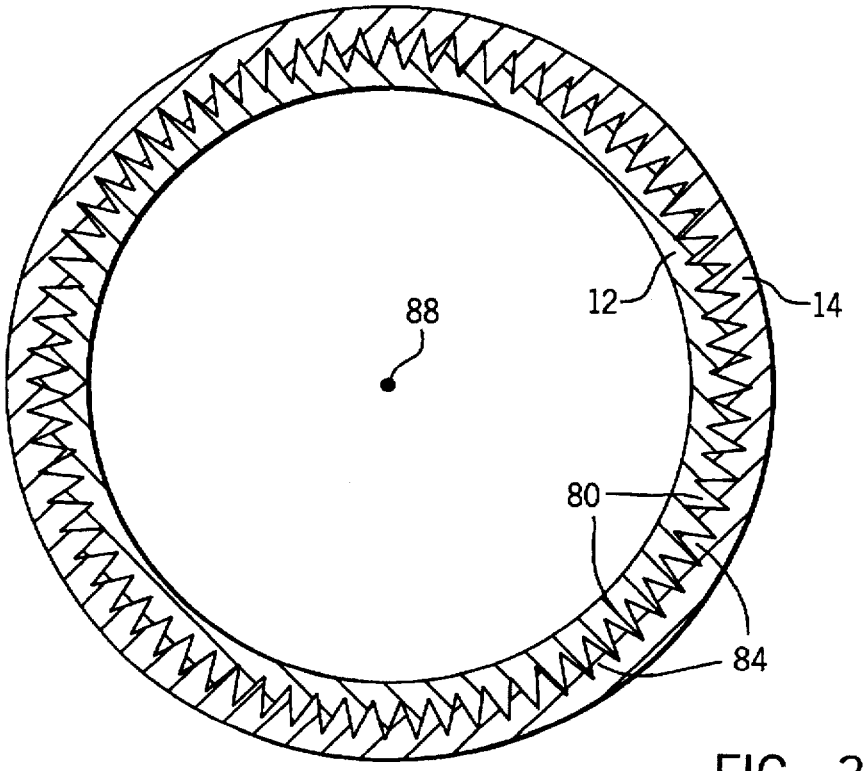
FIG. 3 is a cross-sectional view taken along the line 3—3 of FIG. 1.

Referring to FIG. 2B, the skirt surface 58 defines a first keyed pattern of recesses 78 and protrusions or teeth 80. Referring also to FIG. 4, upper edge 55 of collar surface 29 defines a second keyed pattern of recesses 82 and teeth 84. Importantly, for the purposes of the present invention, the collar recesses and teeth 82, 84 complement the recesses 78 and teeth 80 of skirt 58 so that the skirt 58 and collar 29 effectively mate when properly oriented. In FIGS. 2B and 3, the first keyed pattern includes a plurality of identically sized teeth 80 equally spaced about the circumference of the skirt 58 which extend radially outwardly and downwardly approximately tangentially relative to an angle Φ from the plane defined by the lower surface 99 of spool 12. Similarly, in FIG. 4, the surface of collar 29 defines identically sized and equally spaced teeth 84. The keyed collar teeth pattern of edge 55 extends radially at angle Φ from the plane defined by collar 29. Preferably, for support purposes, the angle Φ is between 30 and 60 degrees. By aligning the skirt teeth 80 with recesses 82 between the collar teeth 84, the spool 12 can be lowered into the well casing until the two sets of teeth are leaved together and enmeshed like a pair of complementary gears. When the skirt 58 and collar 29 are interlocked as described above, the spool 12 is locked into a single orientation relative to the well casing 14 and rotation is eliminated. Pump torque is absorbed by the skirt 58 and collar 29 teeth 80, 84.

To install the spool 12 of the present invention, as in FIG. 1, an extension pipe 97 is attached to the uppermost cylindrical portion 72 of the spool 12. In the preferred embodiment shown in FIG. 1, the extension pipe 97 would be screwed onto the threaded portion 74 of spool 12. This connection may be made in any manner known in the art, including welding, threading, etc. Next, a lower extension pipe 93 is attached to the lower portion of spool 12. The inside chamber of extension pipe 93 fluidly communicates with the internal chamber 44, lateral outlets 71, external chamber 76, outlet 34 and lateral pipe 38. A submersible liquid pump 95 is connected to the lowermost end of the extension pipe 93, this lowermost end lying below the fluid table. The assembly of extension pipes 93, 97, spool 12 and pump 95 is lowered pump-first down through well casing section 90 and through the upper section 16 of the well casing 14. The assembly is continually lowered until the skirt 58 of spool 12 makes initial contact with the collar 29.

At this point the lowermost end of the extension pipe 93 and the pump 95 should be below the fluid level and the skirt 58 and collar 29 should cooperate to impede substantial additional spool descent. Next, a slight rotational torque is placed on the spool from above, tending to rotate the spool about the central casing axis 88. Where the skirt and collar keyed patterns are already interlocked, the spool 12 will not rotate under the rotational torque. However, where the skirt and collar patterns are not yet interleaved, the spool should rotate in the intended direction through a slight arc until the skirt teeth 80 align with the collar recesses 82 and the collar teeth 84 align with the skirt recesses 78 at which point the spool should drop down into the well casing slightly further, the two keyed patterns becoming interlocked as described above. Referring also to FIG. 3, once in an operational position with teeth 80, 84 interlocked, the spool 12 is prohibited from rotating around axis 80.

Referring again to FIG. 1, with the spool 12 and casing 14 interlocked, the O-rings 26 and 28 are sandwiched between the sealing extensions 46, 48 and the inside surface 27, forming watertight seals.

In operation, when the pump is excited, the pump pumps fluid up through the extension pipe 93, into the internal chamber 44, through the outlets 71 and into the external spool chamber 76. The confines of the external chamber 76 redirect the fluid through outlet 34 and lateral pipe 38 to a faucet (not shown) or the like.

Referring still to FIG. 1, when in its operational position with teeth 80, 84 locked and extension pipe 93 extending downwardly from spool 12, the skirt 58 and collar 29 act as a hanging mechanism and bear the majority of the weight of components, extension pipes 93, 97, pump 95, and spool 12, suspended within the well casing 14. Thus, while pump torque can often have a slight upwardly directed component which tends to force the spool upwardly, this force is generally not sufficient to overcome the combined weight of the system components extension pipes 93, 97, pump 95, and spool 12.

Nevertheless, to ensure that the spool 12 remains locked relative to the casing 14, it may be desirable to provide an additional hold down mechanism (not shown) attached to the top end of the spool 12. Such a hold down mechanism would not serve to limit spool 12 rotation as do the prior art locking mechanisms, but would eliminate longitudinal movement of the spool 12 in the upward direction which could ultimately result in an un-locking of the spool and casing. Importantly, the skirt and collar of the present invention would still lock and eliminate rotation near the lower end of the spool 12, below O-ring 28.

To remove the spool 12 for maintenance purposes, with any hold down mechanism released, the spool is simply lifted upwardly out of its locked and operational position and ascended through upper casing section 16 and well casing section 90. There is no need to manipulate springs, screws, clamps, or other mechanical components within the casing Thus, a simple and reliable spool locking mechanism has been described. The present locking mechanism can be implemented with only slight variations to conventional spool and casing parts thus eliminating the need for additional locking components. In addition, systems incorporating the present invention include a spool which is particularly easy to install and remove.

Figure 5:
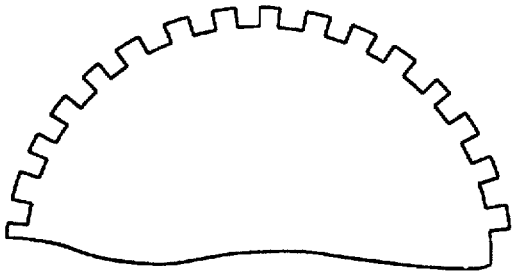
FIG. 5 is a schematic of a second embodiment showing a keyed pattern of the present invention.
Figure 6:
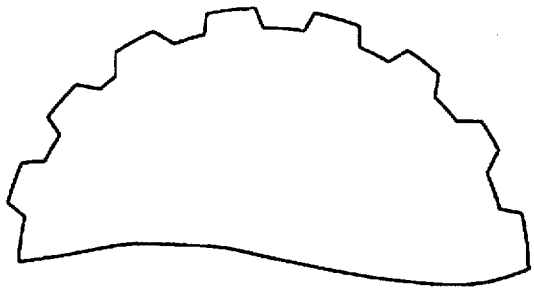
FIG. 6 is a schematic similar to that of FIG. 5 showing a third keyed pattern embodiment.
Figure 7:
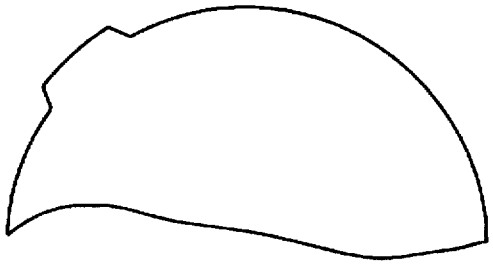
FIG. 7 is a schematic similar to that of FIG. 5 showing a fourth keyed pattern embodiment.

Although the preferred embodiment of the invention has been described above, the invention claimed is not so restricted. For example, instead of providing the keyed pattern on the collar and skirt as described above, the present invention contemplates providing the keyed patterns on any adjacent spool surface and well casing surface. For example, the complementary keyed patterns may be provided on the external surfaces 60 and 62 and adjacent inside surface 27. In addition, if desired, more than one spool surface may be provided with a keyed pattern and complementary keyed patterns for each of the keyed pattern surfaces of the spool may be provided on adjacent well casing areas to spread the torque absorbing function of the keyed surfaces among various parts of the spool. Moreover, referring to FIGS. 5, 6, and 7, many different types of keyed patterns are contemplated by the present invention, including square teeth (see FIG. 5), rectangular teeth (see FIG. 6), and a single keyed tooth (see FIG. 7). A simple keyed pattern such as that shown in FIG. 7 may be desirable as required tolerances would be easier to meet.

In addition to the keyed patterns described above, the present invention also contemplates less conventional keyed patterns such as geometric interlocking shapes. For example, square, oval, or triangular patterns which could easily impede rotation (e.g. a square peg cannot be rotated when inserted into a similarly sized square aperture). Furthermore, referring to FIG. 1, while the skirt including the keyed pattern and the collar are shown as being below the outlet 34, and it is believed that this is the best orientation for the keyed pattern, the claims of the invention contemplate orienting the skirt and collar above the outlet 34 as well as below.

While the present invention is described as having fully complementary adjacent keyed patterns for locking purposes, the keyed patterns may in fact be only partially complementary, non-complementary portions designed so that they do not impede the complementary portions of the surfaces from interlocking.

In addition, in the preferred embodiment, the external diameters of upper and lower sealing extensions 46 and 48 are similar, while both are slightly smaller than the internal diameter of cylindrical inside surface 27. However, the claimed invention is not restricted to inventions in which the upper and lower sealing extensions are of equal diameter and inside surface 27 is cylindrical. For example, inside surface 27 may be frustum-shaped and upper and lower sealing extensions 46 and 48 may be of unequal diameter.

Thus, the invention is not limited by the specific description above, rather it should be judged by the claims which follow.

We claim:

1. A well construction having a vertical well casing and a spool, the spool being insertible into the well casing so that both the spool and well casing are oriented around a central casing axis, the spool forming at least one keyed spool surface, the well casing forming at least one keyed casing surface, the keyed surfaces defined by recesses and protrusions, the keyed spool surface being at least partially complementary to the keyed casing surface, the keyed spool and casing surfaces arranged and the spool positionable within the well casing in an operating position such that the recesses and protrusion of the at least partially complementary portions of the keyed spool and casing surfaces are interlocked, the interlocked recesses and protrusions preventing the spool from rotating about the central casing axis with respect to the well casing.

2. The well casing of claim 1 wherein the well casing also forms an at least partially horizontal collar surface and the spool forms a skirt surface, and, when the spool is in the operating position, the skirt and collar surfaces form at least partially seated contact engagement which limits longitudinally downward movement of the spool inside the well casing.

3. The well construction of claim 2 wherein the at least one skirt surface is the keyed spool surface and the at least one collar surface is the keyed casing surface.

4. The well construction of claim 1 wherein the well casing also includes a lateral sleeve section extending radially outwardly away from the central casing axis for connection to a lateral delivery pipe and the keyed casing surface is located below the lateral sleeve section.

5. The well construction of claim 4 wherein the spool also includes at least one sealing means below the lateral sleeve forming a seal between the spool and the well casing and the keyed casing surface is located below the at least one sealing means.

6. The well construction of claim 3 wherein the skirt surface makes substantially full contact with the collar surface.

7. The well construction of claim 1 wherein the keyed spool and casing surfaces form complementary toothed surfaces.

8. The well construction of claim 2 wherein the skirt and collar surfaces are generally angled downwardly and radial inwardly.

9. The well construction of claim 8 wherein the angle of the collar and skirt surfaces is between approximately 30 and 60 degrees.

10. The well construction of claim 9 wherein the well casing also includes a lateral sleeve section extending radially outwardly away from the central casing axis for connection to a lateral delivery pipe and the collar surface is located below the lateral sleeve section.

11. The well construction of claim 10 wherein the spool also includes at least one sealing means below the lateral sleeve forming a seal between the spool and the well casing and the collar surface is located below the at least one sealing means.

12. The well construction of claim 5 wherein the sealing means is an elastomeric O-ring.

13. A well construction having a vertical well casing and a spool, the spool being insertible into the well casing so that both the spool and well casing are oriented around a central casing axis, the spool forming at least one skirt surface defining a first keyed pattern of recesses and protrusions, the well casing forming at least one partially horizontal collar surface defining a second keyed pattern of recesses and protrusions, the keyed patterns and collar and skirt surfaces defined and arranged, and the spool positionable within the well casing in an operating position, such that the skirt and collar surfaces form at least partially seated contact engagement which limits longitudinally downward movement of the spool inside the well casing and the keyed patterns are at least partially in contact so as to prevent the spool from rotating about the central casing axis with respect to the well casing.

14. The well construction of claim 11 wherein the first and second keyed patterns form complementary surfaces and make full contact.

15. A well construction having a vertical well casing and a spool, the spool being insertible into the well casing so that both the spool and well casing are oriented around a central casing axis, the well casing also includes a lateral sleeve section extending radially outwardly away from the central casing axis for connection to a lateral delivery pipe, the spool also including at least one sealing means below the lateral sleeve forming a seal between the spool and the well casing, the spool forming at least one skirt surface defining a first keyed pattern of recesses and protrusions, the well casing forming at least one partially horizontal collar surface defining a second keyed pattern of recesses and protrusions which is complementary to the first keyed pattern, the collar surface located below the at least one sealing means, the keyed patterns and collar and skirt surfaces defined and arranged, and the spool positionable within the well casing in an operating position, such that the skirt and collar surfaces form at least partially seated contact engagement which limits longitudinally downward movement of the spool inside the well casing and the recesses and protrusions of the keyed patterns intermesh so as to prevent the spool from rotating about the central casing axis with respect to the well casing.

* * * * *